US011527396B2

(12) United States Patent
Knutas et al.

(10) Patent No.: US 11,527,396 B2
(45) Date of Patent: Dec. 13, 2022

(54) MULTIPOLE WITH MOUNTING RINGS ARRANGED ON THE END FACES THEREOF, AND MOUNTING RING OF SAID TYPE

(71) Applicant: VACUTEC Hochvakuum- & Praezisionstechnik GmbH, Bremen (DE)

(72) Inventors: Roman Knutas, Delmenhorst (DE); Carsten Laser, Weyhe (DE)

(73) Assignee: VACUTEC Hochvakuum- & Praezisionstechnik GmbH, Bremen (DE)

( * ) Notice: Subject to any disclaimer, the term of this patent is extended or adjusted under 35 U.S.C. 154(b) by 0 days.

(21) Appl. No.: 17/506,856

(22) Filed: Oct. 21, 2021

(65) Prior Publication Data

US 2022/0139689 A1 May 5, 2022

(30) Foreign Application Priority Data

Oct. 30, 2020 (DE) ..... 10 2020 128 646.5

(51) Int. Cl.
*H01J 49/00* (2006.01)
*H01J 49/06* (2006.01)

(52) U.S. Cl.
CPC ..... *H01J 49/068* (2013.01); *H01J 49/063* (2013.01)

(58) Field of Classification Search
CPC ..... H01J 49/068; H01J 49/063
USPC ..... 250/281, 282
See application file for complete search history.

(56) References Cited

U.S. PATENT DOCUMENTS

| | | | | |
|---|---|---|---|---|
| 2,939,952 | A | 6/1960 | Paul et al. | |
| 10,504,710 | B2 | 12/2019 | Knutas | |
| 2006/0102835 | A1* | 5/2006 | Laser | H01J 49/068 250/282 |
| 2018/0286654 | A1* | 10/2018 | Knutas | H01J 49/4255 |

FOREIGN PATENT DOCUMENTS

| | | | |
|---|---|---|---|
| DE | 944 900 | C | 6/1956 |
| EP | 3 385 979 | A1 | 10/2018 |

* cited by examiner

*Primary Examiner* — Michael Maskell
(74) *Attorney, Agent, or Firm* — Collard & Roe, P.C.

(57) ABSTRACT

A multipole with mounting rings arranged on its end faces for mounting the multipole in a mass spectrometer includes two electrode half-shells each having at least two electrodes joinable together by positive-fitting connections on the electrode half-shell longitudinal edges. Each positive-fitting connection includes a fitting and a matching mating fitting, the fitting integrally formed on one electrode half-shell and the mating fitting integrally formed on the other electrode half-shell. Each mounting ring has two mounting ring fittings. One mounting ring fitting can be joined to a mating fitting integrally formed on one of the two electrode half-shells and the other of the two mounting ring fittings can be joined to a mating fitting integrally formed on the other of the two electrode half-shells. Furthermore, a mounting ring for such a multipole has two mounting ring fittings joinable to corresponding mating fittings integrally formed on the electrode half-shells.

10 Claims, 4 Drawing Sheets

MULTIPOLE WITH MOUNTING RINGS ARRANGED ON THE END FACES THEREOF, AND MOUNTING RING OF SAID TYPE

CROSS REFERENCE TO RELATED APPLICATIONS

Applicant claims priority under 35 U.S.C. § 119 of German Application No. 10 2020 128 646.5 filed Oct. 30, 2020, the disclosure of which is incorporated by reference.

BACKGROUND OF THE INVENTION

1. Field of the Invention

The invention relates to a multipole with mounting rings arranged on its end faces for mounting the multipole in a mass spectrometer, wherein the multipole has two electrode half-shells each with at least two electrodes, which can be joined together by positive connections arranged on the longitudinal edges of the electrode half-shells. Each of the positive connections comprises a fitting and a mating fitting matched to it, with the fitting being integrally formed on one of the two electrode half-shells and the mating fitting on the other of the two electrode half-shells.

The invention also relates to a mounting ring for such a multipole.

2. Description of the Related Art

The invention relates to multipoles such as those used in mass spectrometers. Multipoles are multi-polar electrode devices and are well known, for example from the German patent specification DE 944900.

As stated in EP 3 385 979 A1, on the one hand, precise alignment of the electrodes of the electrode device relative to each other is essential for the analytical measuring accuracy so that the electrodes are normally fixed to a carrier element designed as a half-shell. Such half-shells can be assembled with high accuracy, so that a high analytical measuring accuracy of a mass spectrometer can be achieved.

On the other hand, the installation of a multipole in a mass spectrometer must be carried out with the highest possible accuracy in order to achieve a high measuring accuracy.

FIGS. 1 to 3 show the conventional structure of a known multipole 10, with mounting rings 12, 14 attached to the end faces of the multipole for mounting the multipole in a mass spectrometer, not shown, wherein FIG. 1 shows an exploded view of the multipole 10 together with the two mounting rings 12, 14, FIG. 2 shows a perspective view of an assembled multipole 10 together with the mounting rings 12, 14 according to FIG. 1, and FIG. 3 shows a perspective view of an assembled multipole 10 with the mounting rings 12, 14 removed.

This conventional multipole 10 comprises two electrode half-shells 16, 18, each with two rod-shaped electrodes 20, 22 and 24, 26, which are each fixed in pairs on a carrier 28, 30, connected together by insulating bodies 32, 36, 38.

The lower electrode half-shell 16 can be joined to the upper electrode half-shell 18 via positive-fitting connections 40, 42, 44, arranged on the longitudinal edges 46, 48, 50, 52 of the electrode half-shells 16, 18.

In this case, the term longitudinal edge is not to be understood in a one-dimensional sense, but rather in such a way that the longitudinal edges 46, 48, 50, 52 form narrow surfaces, the width of which corresponds to the thickness of the carriers 28, 30.

In FIGS. 1 to 3, for reasons of presentation, the positive-fitting connections are only designated along the front longitudinal edges 46, 50; corresponding positive-fitting connections also exist along the rear longitudinal edges 48, 52, but are not separately designated there. Each of these positive-fitting connections 40, 42, 44 comprises a fitting 54, 56, 58 with a roof structure on the lower electrode half-shell 16 and a mating fitting 60, 62, 64 matched to it, having a prism structure on the upper electrode half-shell 18.

The electrode half-shells 16, 18 are structured and shaped identically. Therefore, the lower electrode half-shell 16 also has mating fittings 66, 68, 70 on its rear longitudinal edges 48, which are integrally formed with corresponding fittings (not visible in the figures) on the rear longitudinal edge 52 of the upper electrode half-shell 18 and form further positive-fitting connections in pairs.

All of these positive-fitting connections are secured with screws 72, 74, 76, 78, 80, 82.

In the present context, a positive-fitting connection is understood to mean a connection that eliminates a relative displacement of two components, at least in one dimension. This means that the positive-fitting connections described in this document between the fitting and the mating fitting are designed in such a way that, after being joined, the two electrode half-shells 16, 18 can be moved in the longitudinal direction of the multipole 10 until the screws 72, 74, 76, 78, 80, 82 are installed. However, due to these positive-fitting connections, displacement of the electrode half-shells 16, 18 in the radial direction of the multipole 10 is not possible.

The two front and rear end faces 84, 86 are terminated by the mounting rings 12, 14, which are clamped to clamping lugs 88—provided on the electrode half-shells 16, 18—by turning the mounting rings 12, 14.

These mounting rings 12, 14 are used to mount the multipole 10 in the mass spectrometer. The alignment and positioning of the multipole 10 in the mass spectrometer can therefore only be achieved with an accuracy limited by the attachment of the mounting rings 12, 14 to the multipole 10. To achieve a high degree of accuracy, it is therefore necessary to adapt the mounting rings 12, 14 to the clamping lugs 88, which often requires individual reworking of the mounting rings 12, 14 and/or the electrode half-shells 16, 18 in the area of the clamping noses 88. A high degree of accuracy can therefore only be achieved with significant processing effort.

SUMMARY OF THE INVENTION

The object of the invention is therefore to enable the mounting of a multipole in a mass spectrometer with high accuracy but at the same time with little effort.

This object is achieved by means of the features of a multipole according to one aspect of the invention and by means of a mounting ring having the features of another aspect of the invention.

The multipole according to the invention therefore has mounting rings arranged on its end faces for mounting the multipole in a mass spectrometer, wherein the multipole has two electrode half-shells each with at least two electrodes, which can be joined together by positive-fitting connections arranged on the longitudinal edges of the electrode half-shells, each positive-fitting connection comprising a fitting and a mating fitting matched to it, wherein the fitting is integrally formed on one of the two electrode half-shells and the mating fitting is integrally formed on the other of the two electrode half-shells. According to the invention, each of the mounting rings has two mounting ring fittings, wherein each of the two mounting ring fittings can be joined to a mating fitting integrally formed on one of the two electrode half-shells and the other of the two mounting ring fittings can be joined to a mating fitting integrally formed on the other of the two electrode half-shells.

The mounting ring according to the invention for such a multipole therefore has two mounting ring fittings which are designed so as to be joined to correspondingly designed mating fittings that are integrally formed on the electrode half-shells.

In this way, according to the invention, the mounting rings can also form precisely fitting positive-fit connections with the electrode half-shells, which guarantee a high accuracy when installing the multipole in the mass spectrometer with little installation effort.

This design of the mounting rings and the multipole makes it possible to manufacture the fittings and mating fittings of the electrode half-shells by grinding the electrodes jointly with the fittings and mating fittings of the electrode half-shells. In this way, the mating parts on the electrode half shells—as well as their fittings—are manufactured with the high accuracy of the electrodes. This means that the mating fittings into which the mounting ring fittings engage are machined with the same high accuracy as the electrodes. This processing is carried out in a common processing step and is therefore possible with minimal effort. The surfaces of the mounting ring fittings can be produced separately with high precision, for example by milling the mounting rings.

Overall, the invention therefore allows a very accurate mounting of the multipole in the mass spectrometer to be achieved with relatively little effort.

The mating part of one of the electrode half-shells, which can be joined to a mounting ring fitting, is preferably part of one of the positive-fitting connections for joining the two electrode half-shells together. This is advantageous because a mating fitting of the electrode half-shells can thus be used for a connection of a mounting ring to the multipole and thus no separate additional mating fitting needs to be provided on the multipole for joining it to a mounting ring.

An alternative embodiment of the invention provides that the mating fitting of one of the electrode half-shells, which can be joined to a mounting ring fitting, is designed separately from the mating fittings of the electrode half-shells, which are provided for the positive-fitting connections for joining the two electrode half-shells together.

An extension of the invention provides that the fittings each have a roof structure and the mating fittings each have a prism structure, so that each fitting and the mating piece joined to it form a roof-and-prism connection. The invention has recognized that such flat structures can be ground with high accuracy and low effort, while still allowing reliable and precise positioning of the parts to be assembled.

According to an extension of the invention, each fitting can be screwed to the mating piece which is joined to it by means of a screw to form a screw connection. Such screw connections have proved to be particularly reliable.

An extension of the invention provides that each electrode half-shell has a plurality, preferably three, of mating fittings on a longitudinal edge, with the two outer mating fittings each having two drilled holes for screws. Each of the two outer screws can be screwed to a different one of the two mounting ring fittings. An extension of the invention also provides that the fittings on the electrode half-shells and the mounting ring fittings each have a threaded hole for receiving one of the screws. This construction can be produced with little effort and assembled with little effort, and is therefore particularly advantageous.

An extension of the invention provides that the mounting ring fittings are integrally formed on the respective mounting ring in a rotationally symmetric manner. The mounting ring fittings are preferably arranged to be rotationally symmetric by 180°. On account of this design, identical mounting rings can advantageously be used on both end faces.

This enables the electrode half-shells also to be designed identically. This means that the upper electrode half-shell is designed in the same way as the lower electrode half-shell. In addition, both mounting rings are the same and are rotationally symmetric by 180°. Due to these designs, only one electrode half-shell type and only one mounting ring type is required for a multipole to be produced. Therefore, two different electrode half-shells or two different mounting rings do not need to be produced and stocked. This reduces manufacturing and storage costs while maintaining the same quality of the parts that are identical in construction.

Extensions of the invention are derived from the patent claims, the description and the drawings. The advantages of features and combinations of multiple features mentioned above are only exemplary and may have an alternative or cumulative effect without the advantages necessarily having to be obtained from embodiments according to the invention. Further features can be found in the drawings—in particular the illustrated geometries and dimensions of several components relative to each other as well as their relative arrangement and effective connection. The combination of features of different embodiments of the invention or of features of different claims is also possible in deviation from the chosen cross references of the claims and is thereby encouraged. This also applies to those features which are shown in separate drawings or are mentioned in their description. These features can also be combined with features of different claims. Likewise, the features listed in the claims may be omitted for other embodiments of the invention.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
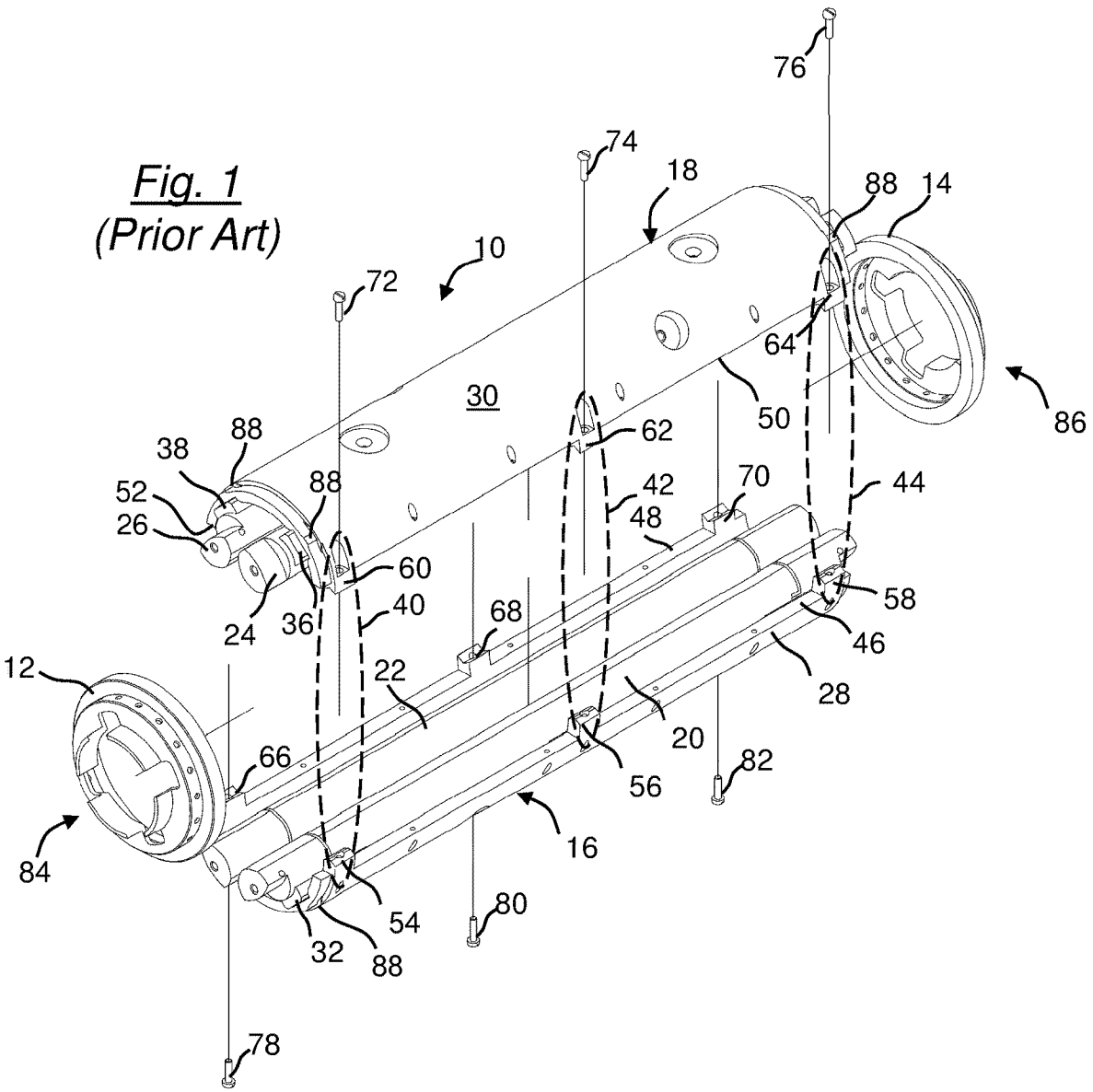
Fig. 1 (Prior Art)
FIG. 1 an exploded view of a multipole including mounting rings according to the prior art, FIG. 2 a perspective view of the multipole shown in FIG. 1 in the assembled state with the mounting rings, FIG. 3 a perspective view of the multipole shown in FIG. 1, in the assembled state without mounting rings, FIG. 4 an exemplary embodiment of a multipole according to the invention in an exploded view, FIG. 5 a perspective view of the multipole shown in FIG. 4 in the assembled state with the mounting rings, and FIG. 6 a perspective view of the multipole shown in FIG. 4, in the assembled state without mounting rings.
Figure 2:
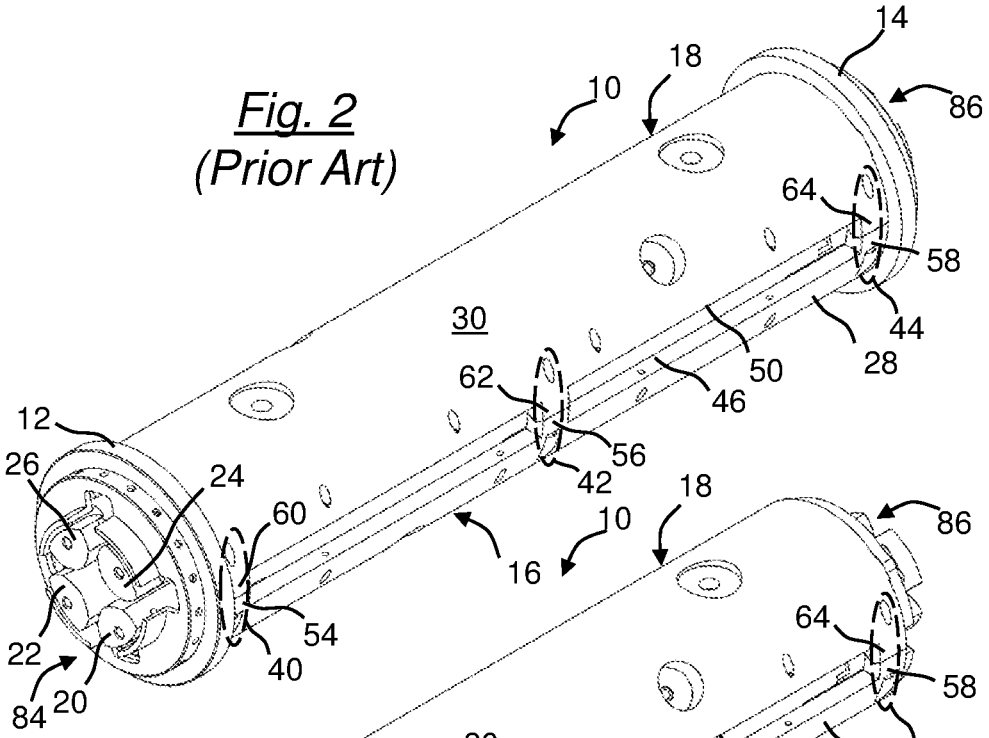
Fig. 2 (Prior Art)
Figure 3:
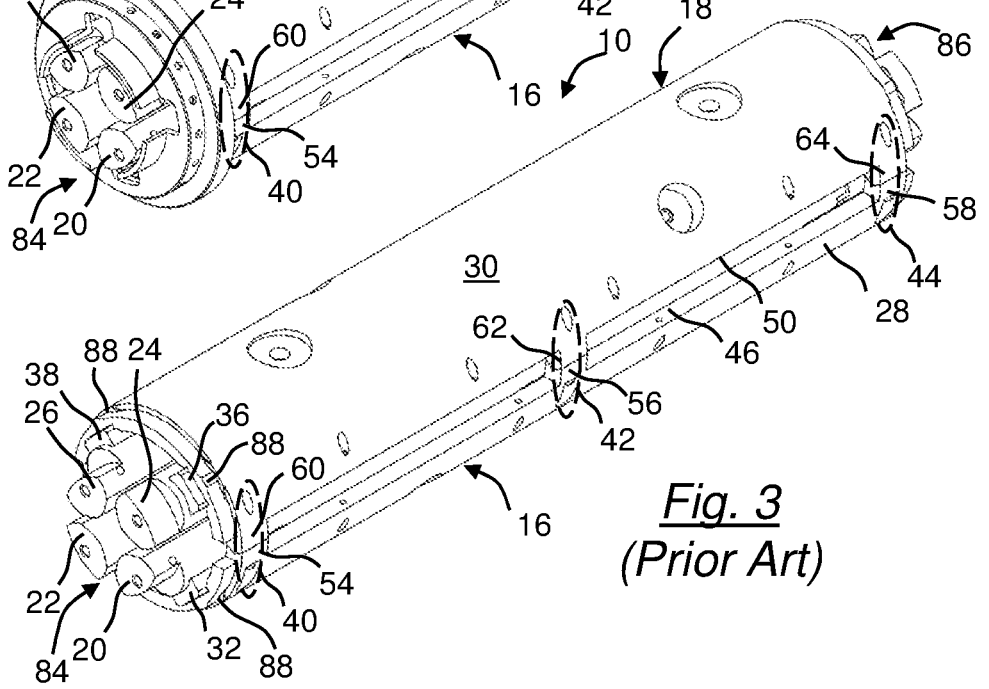
Fig. 3 (Prior Art)

FIGS. 1 to 3 have already been described above. The statements made there for the definition of terms also apply to the following description of an exemplary embodiment according to the invention.

Figure 4:
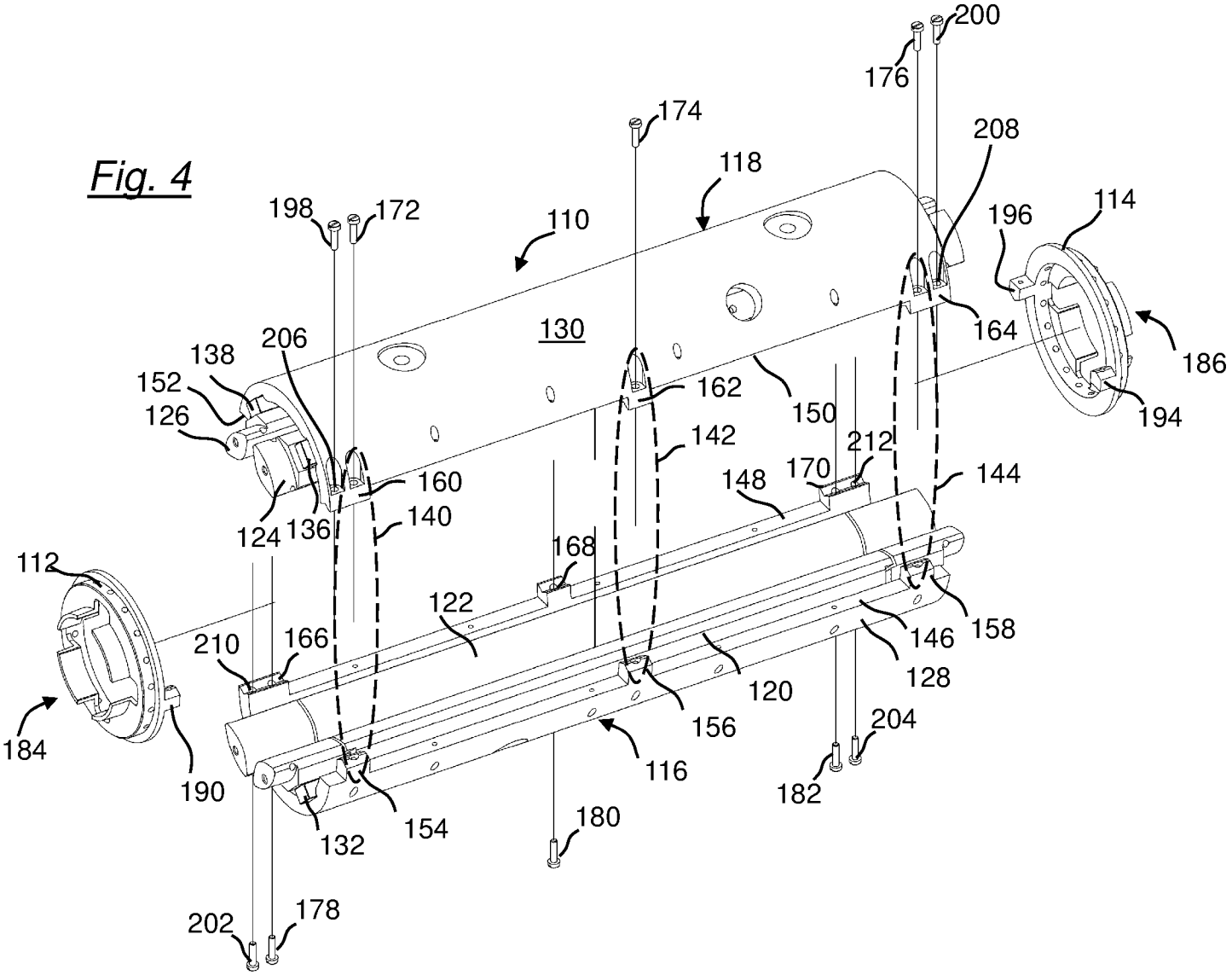
Figure 5:
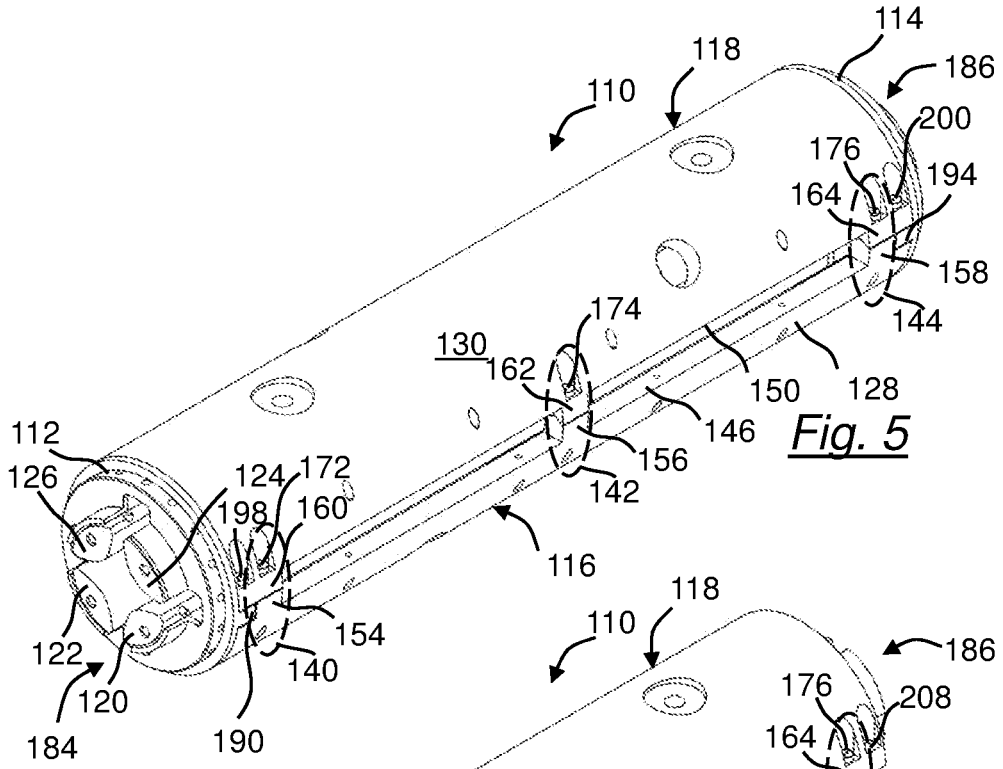
Figure 6:
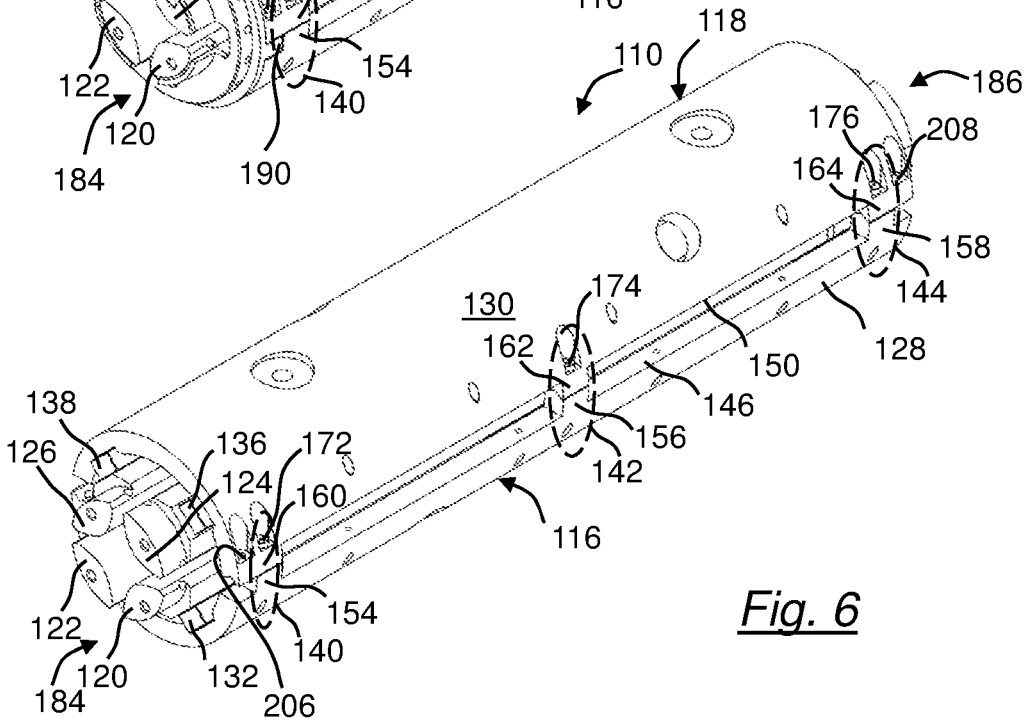

FIGS. 4 to 6 show an exemplary embodiment of a multipole 110 according to the invention with mounting rings 112, 114 attached to the end faces of the multipole 110 for mounting the multipole 110 in a mass spectrometer, not illustrated. FIG. 4 shows an exploded view of this multipole 110 together with the two mounting rings 112, 114. FIG. 5 shows a perspective view of the assembled multipole 110 together with the mounting rings 112, 114 according to FIG. 4. FIG. 6 shows a perspective view of the assembled multipole 100, but with the mounting rings 112, 114 removed.

The multipole 110 comprises two electrode half-shells 116, 118. Each of these electrode half-shells 116, 118 has a plurality, namely in the example two, of rod-shaped electrodes 120, 122 and 124, 126. Each pair of these electrodes 120, 122 or 124, 126 is fixed on a carrier 128, 130, connected together by insulating bodies 132, 136, 138. These insulating bodies 132, 136, 138 electrically insulate the electrodes 120, 122, 124, 126 from the carriers 128, 130. For example, the insulating bodies 132, 136, 138 can be made of quartz or quartz glass.

Each of the carriers 128, 130 is essentially shaped like a half-hollow cylinder fitted with recesses and holes, i.e. a hollow cylinder cut open lengthwise. These carriers 128, 130 are made of metal or a metal alloy and are electrically conductive and have a specified wall thickness.

The electrodes 120, 122, 124, 126 in the illustrated exemplary embodiment are each designed in three parts. They each have a longer central section and two shorter outer sections. The outer sections are used, for example, to form a pre-filter and a post-filter. Alternatively, the electrodes 120, 122, 124, 126 (contrary to the exemplary embodiment shown) can each be designed as one piece.

The lower electrode half-shell 116 can be joined to the upper electrode half-shell 118 via positive-fitting connections 140, 142, 144, arranged along the longitudinal edges 146, 148, 150, 152 of the electrode half-shells 116, 118. As already mentioned above, these longitudinal edges 146, 148, 150, 152 form narrow surfaces, the width of which corresponds to the wall thickness of the carriers 128, 130.

Analogous to FIGS. 1 to 3, in FIGS. 4 to 6 the positive connections 140, 142, 144 are also only designated along the frontal longitudinal edges 146, 150 for reasons of presentation, however, corresponding positive-fitting connections are also provided along the rear longitudinal edges 148, 152. Each of these positive-fitting connections 140, 142, 144 shown as well as the non-illustrated positive-fitting connections comprises a fitting 154, 156, 158 with a roof structure on the lower electrode half-shell 116 and a mating fitting 160, 162, 164 matched to it that has a prism structure on the upper electrode half-shell 118.

The electrode half-shells 116, 118 are structured and shaped in the same way. Therefore, the lower electrode half-shell 116 on its rear longitudinal axis 148 also has mating fittings 166, 168, 170, which are integrally formed with corresponding fittings (not visible in FIGS. 4 to 6) on the rear longitudinal edge 152 of the upper electrode half-shell 118 and in each case form pairs of further positive-fitting connections (not separately designated). These positive-fitting connections are secured with screws 172, 174, 176, 178, 180, 182.

A mounting ring 112 is provided on the front end face 184. A mounting ring 114 is provided on the rear end face 186 in the same way. The mounting of these mounting rings 112, 114 on the multipole 110 differs considerably from the prior art according to FIGS. 1 to 3. Namely, two mounting ring fittings 190, 194, 196 are provided on each of the mounting rings 112, 114. For each of the mounting rings 112, 114, one of its two mounting ring fittings 190, 194 respectively can be joined to a mating fitting 160 or 164, integrally formed on one of the two electrode half-shells 118, and the other of the two mounting ring fittings 196 can be joined to a mating fitting 166, 170 integrally formed on the other of the two electrode half-shells 118.

The mating fitting 160 of the electrode half-shell 118, which can be joined to the mounting ring fitting 190 of the mounting ring 112, is part of the positive-fitting connection 140 with which the two electrode half-shells 116, 118 are joined together. A further, not shown, mounting ring fitting of the mounting ring 112 is joined together with the mating fitting 166 of the electrode half-shell 116 and is also part of a positive connection between the two electrode half-shells 116, 118.

In the same way, the mating fitting 164 of the electrode half-shell 118, which can be joined to the mounting ring fitting 194 of the mounting ring 114, is part of the positive-fitting connection 144 with which the electrode half-shells 116, 118 are connected. The further mounting ring fitting 196 of the mounting ring 114 is joined to the mating fitting 170 of the electrode half-shell 118 and is also part of a positive-fitting connection between the two electrode half-shells 116, 118.

These positive-fitting connections between the mounting rings 112, 114 and the electrode half-shells 116, 118 are secured with screws 198, 200, 202, 204 to form screw connections. Additional drilled holes 206, 208, 210, 212 are provided in the mating fittings 160, 164, 166, 170 for this purpose, through which holes these screws 198, 200, 202, 204 are passed. The mounting ring fittings 190, 194, 196 of the mounting rings 112, 114 have threaded holes for receiving these screws 198, 200, 202, 204.

The mounting fittings 190, 194, 196 of the mounting rings 112, 114 each have a roof structure and can be joined to matching prism structures of the mating fittings 160, 164, 166, 170 to form roof-and-prism connections.

As stated above, a positive-fitting connection is a connection which excludes a relative displacement of two components at least in one dimension, so that the positive connections described in this document are formed by a fitting with a mating fitting in such a way that, after being joined to the electrode half-shells 116, 118, the mounting rings 112, 114 can be moved in the longitudinal direction of the multipole 110 until the screws 172, 174, 176, 178, 180, 182 are installed. However, such a displacement of the electrode half-shells 116, 118 and the mounting rings 112, 114 in the radial direction of the multipole 110 is then also not possible, on account of these positive-fitting connections. After these screws are tightened, the longitudinal displacements of the multipole 110 are also excluded.

The fixing according to the invention of the mounting rings 112, 114 to the multipole 110 contributes to enabling the alignment and positioning of the multipole 110 in a mass spectrometer with very high accuracy, since the surfaces of the roof structures and prism structures can be produced with very high accuracy and at the same time with little effort. The prism structures of the mating fittings 160, 164, 166, 170 on the electrode half-shells 116, 118 are ground together with the electrodes, wherein this grinding is a highly accurate machining process with an accuracy in the range of a few microns. While the surfaces of the mounting ring fittings 190, 194, 196 of the mounting rings 112, 114 cannot be ground at the same time, they can also be machined with high precision in a separate processing step.

Overall, the invention therefore allows mounting rings to be provided for mounting a multipole in a mass spectrometer, which ensure a high accuracy of the positioning and alignment of the multipole in the mass spectrometer.

Although only a few embodiments of the present invention have been shown and described, it is to be understood that many changes and modifications may be made thereunto without departing from the spirit and scope of the invention.

The figures use the following reference numbers:

10, 110 multipole
12, 112 mounting ring
14, 114 mounting ring
16, 116 electrode half-shell
18, 118 electrode half-shell
20, 120 electrode
22, 122 electrode
24, 124 electrode
26, 126 electrode
28, 128 carrier
30, 130 carrier
32, 132 insulating body
36, 136 insulating body
38, 138 insulating body
40, 140 positive-fitting connection
42, 142 positive-fitting connection
44, 144 positive-fitting connection
46, 146 longitudinal edge
48, 148 longitudinal edge
50, 150 longitudinal edge
52, 152 longitudinal edge
54, 154 fitting
56, 156 fitting
58, 158 fitting
60, 160 mating fitting
62, 162 mating fitting
64, 164 mating fitting
66, 166 mating fitting
68, 168 mating fitting
70, 170 mating fitting
72, 172 screw
74, 174 screw
76, 176 screw
78, 178 screw
80, 180 screw
82, 182 screw
84, 184 end face
86, 186 end face
88 clamping lug
190 mounting ring fitting
194 mounting ring fitting
196 mounting ring fitting
198 screw
200 screw
202 screw
204 screw
206 drilled hole
208 drilled hole
210 drilled hole
212 drilled hole

The invention claimed is:

1. A multipole with mounting rings arranged on its end faces for mounting the multipole in a mass spectrometer, wherein the multipole comprises two electrode half-shells each having at least two electrodes which can be joined together by positive-fitting connections arranged on the longitudinal edges of the electrode half-shells, wherein each positive-fitting connection comprises a fitting and a mating fitting matched thereto, the fitting being integrally formed on one of the two electrode half-shells and the mating fitting being integrally formed on the other of the two electrode half-shells, wherein each of the mounting rings has two mounting ring fittings, wherein one of the two mounting ring fittings can be joined to a mating fitting integrally formed on one of the two electrode half-shells and the other of the two mounting ring fittings can be joined to a mating fitting integrally formed on the other of the two electrode half-shells.

2. The multipole according to claim 1, wherein the mating fitting, which can be joined to a mounting ring, of one of the electrode half-shells is part of one of the positive-fitting connections for joining together the two electrode half-shells.

3. The multipole according to claim 1, wherein the mating fitting, which can be joined to a mounting ring, of one of the electrode half-shells is formed separately from the mating fittings of the electrode half-shells provided for the positive-fitting connections for joining together the two electrode half-shells.

4. The multipole according to claim 1, wherein the fittings each have a roof structure and the mating fittings each have a prism structure, so that each fitting and the mating fitting joined to it each form a roof-and-prism connection.

5. The multipole according to claim 1, wherein each fitting can be screwed to the mating fitting joined to it by means of a screw in order to form a screw connection.

6. The multipole according to claim 1, wherein each electrode half-shell on a longitudinal edge comprises a plurality, preferably three, of mating fittings, wherein the two outer mating fittings each have two drilled holes for screws, wherein each of the two outer screws can be screwed to another of the two mounting ring fittings.

7. The multipole according to claim 6, wherein the fittings on the electrode half-shells and the mounting ring fittings each have a threaded hole for receiving one of the screws.

8. A mounting ring for a multipole according to claim 1, wherein the mounting ring has two mounting ring fittings which are designed in such a way as to be joined to correspondingly designed mating fittings integrally formed on the electrode half-shells.

9. The mounting ring according to claim 8, wherein the mounting ring fittings are integrally formed on the respective mounting ring in a rotationally symmetric manner.

10. The mounting ring according to claim 9, wherein the mounting ring fittings are arranged to be rotationally symmetric by 180°.

* * * * *